US009278268B2

(12) United States Patent
Pallis

(10) Patent No.: US 9,278,268 B2
(45) Date of Patent: Mar. 8, 2016

(54) SYSTEM AND METHOD TO RE-GRIP GOLF CLUBS

(71) Applicant: Todd Pallis, Torrance, CA (US)

(72) Inventor: Todd Pallis, Torrance, CA (US)

( * ) Notice: Subject to any disclaimer, the term of this patent is extended or adjusted under 35 U.S.C. 154(b) by 0 days.

(21) Appl. No.: 14/152,516

(22) Filed: Jan. 10, 2014

(65) Prior Publication Data

US 2014/0194219 A1 Jul. 10, 2014

Related U.S. Application Data

(60) Provisional application No. 61/751,190, filed on Jan. 10, 2013.

(51) Int. Cl.
*A63B 53/14* (2015.01)
*A63B 59/00* (2015.01)

(52) U.S. Cl.
CPC ..... *A63B 53/145* (2013.01); *A63B 59/0074* (2013.01); *A63B 60/14* (2015.10); *A63B 60/16* (2015.10); *A63B 60/24* (2015.10); *A63B 60/42* (2015.10)

(58) Field of Classification Search
CPC .. A63B 53/145; A63B 59/0074; A63B 60/24; A63B 60/16; A63B 60/14; A63B 60/42
See application file for complete search history.

(56) References Cited

U.S. PATENT DOCUMENTS

| | | | | |
|---|---|---|---|---|
| 4,261,567 | A * | 4/1981 | Uffindell | 473/298 |
| 4,934,024 | A * | 6/1990 | Sexton | A63B 49/08 16/421 |
| 4,971,321 | A * | 11/1990 | Davis | 473/287 |
| 5,106,087 | A * | 4/1992 | Simmons et al. | 473/287 |
| 5,299,802 | A * | 4/1994 | Bouchet-Lassale | A63B 49/08 273/DIG. 30 |
| 5,749,792 | A * | 5/1998 | Engfer et al. | 473/300 |
| 5,839,983 | A * | 11/1998 | Kramer | A63B 59/0014 473/457 |
| 7,048,644 | B2 * | 5/2006 | Wang | 473/300 |
| 7,635,310 | B2 * | 12/2009 | Keough | 473/297 |
| 7,798,912 | B2 * | 9/2010 | Kou | 473/300 |
| 8,025,589 | B2 * | 9/2011 | Brinton et al. | 473/290 |
| 2002/0111226 | A1 * | 8/2002 | Wang | 473/300 |
| 2008/0113826 | A1 * | 5/2008 | Lin | 473/302 |
| 2010/0292021 | A1 * | 11/2010 | Voges | 473/300 |
| 2011/0045919 | A1 * | 2/2011 | Mezzi | A63B 53/14 473/298 |
| 2013/0310203 | A1 * | 11/2013 | Hwang | 473/522 |

FOREIGN PATENT DOCUMENTS

| | | | | |
|---|---|---|---|---|
| GB | 2505648 A * | 3/2014 | | A63B 69/3685 |

* cited by examiner

*Primary Examiner* — Stephen Blau
(74) *Attorney, Agent, or Firm* — Fulwider Patton LLP

(57) ABSTRACT

A system and method to re-grip golf clubs includes a series of systematically weighted golf club grips used to achieve a desired swing weight of a golf club. A series of interchangeable weighted tubular fitting grips having a sequence of systematically varying predetermined weights can be removably mounted on a golf club, as desired, to provide the desired swing weight. The tubular fitting grips each have a void through a length of one side of a tubular outer wall allowing each grip to be interchangeably mounted on the golf club.

10 Claims, 2 Drawing Sheets

FIG. 3B
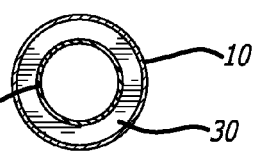
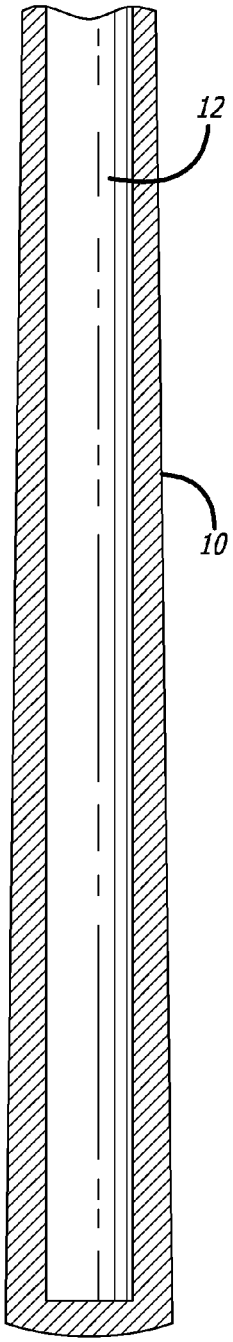
FIG. 1
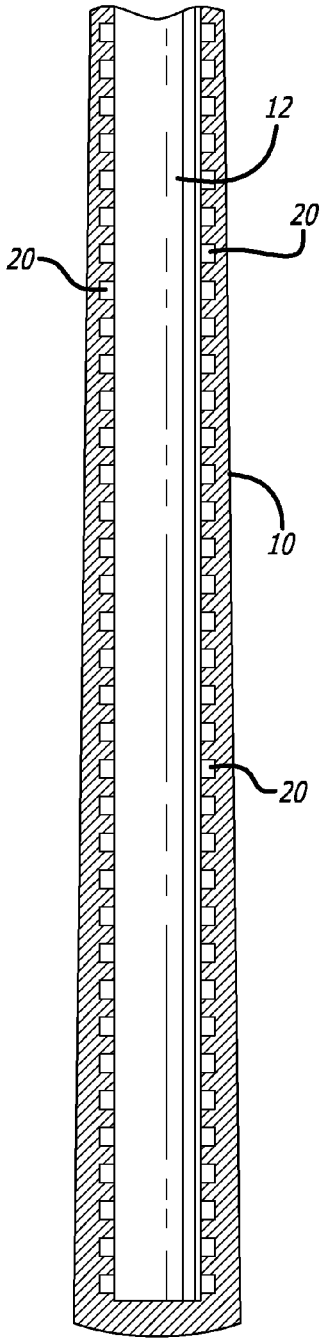
FIG. 2
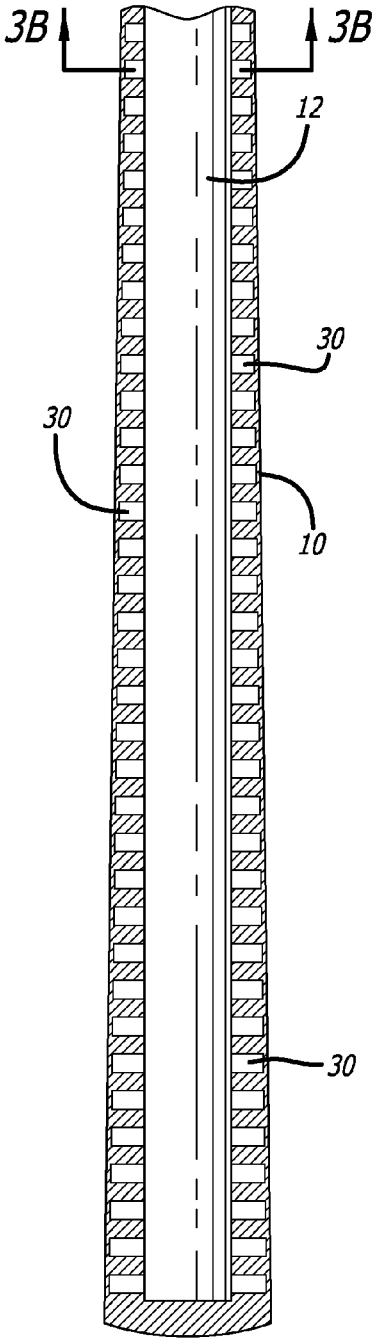
FIG. 3A

FIG. 4
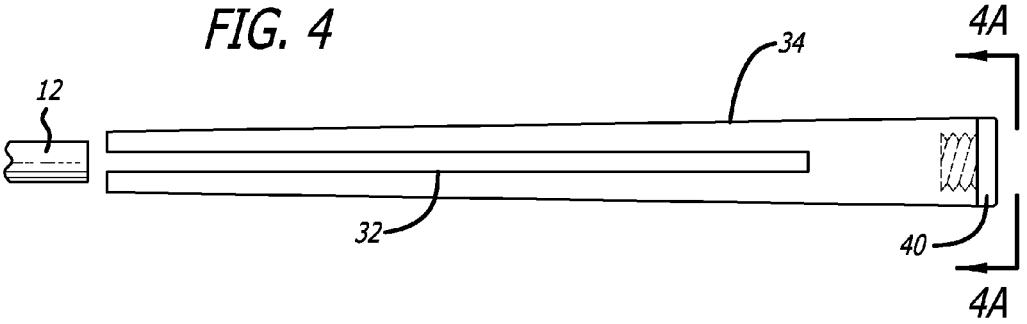
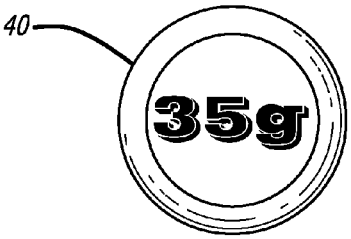
FIG. 4A
FIG. 5
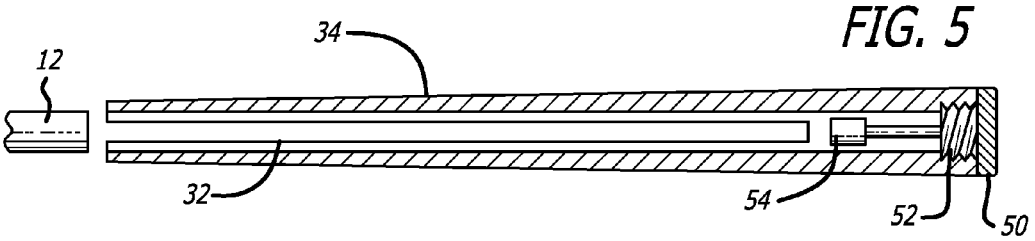
FIG. 5A
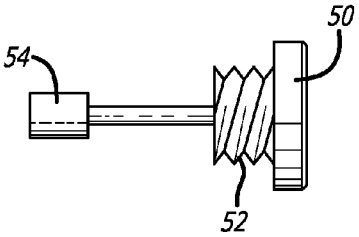
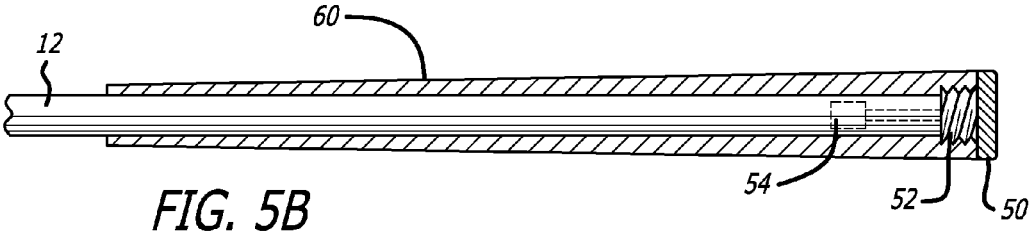
FIG. 5B

SYSTEM AND METHOD TO RE-GRIP GOLF CLUBS

CROSS-REFERENCES TO RELATED APPLICATIONS

This application claims priority from U.S. Provisional Application No. 61/751,190, filed Jan. 10, 2013 incorporated by reference in its entirety.

BACKGROUND OF THE INVENTION

The science of golf club assembly includes fitting a golf club to the user utilizing a number of factors, such as the total weight of the golf club and the distribution of weight from the grip of the golf club to the golf club head, as well as distribution of weight from heel to toe of a golf club head by use of removable weights or permanent weights in the golf club head design. Additionally, re-shafting of a golf club head with a lighter or heavier shaft, or the use of a shaft which has a different length, or a different distribution of weight along the length of the shaft can alter the performance of the club and its relative balance point. One frequently used measure of this balance point is "swing weight" which affects the feel of the golf club in the hands of the user and is measured by means of a fulcrum balance used at a position spaced apart from the heel of or the extreme end of the butt of the grip, the position of pivoting representing the swing weight.

Swing weight is usually designated as an alpha numeric number such as A, B, C, D, E or the like and a number from 1 to 10. A very commonly used series of numbers is C or D, 1 or 2; thus a typical factory swing weight for a man's clubs with steel shafts would be D1 or D2. Similarly, a number for a lady's or senior's shafts could be C4-C8 or the like. One problem with using weights on the head of the club to affect the swing weight during re-shafting is that such a practice may change the balance of the club from heel to toe of the head and otherwise alter the feel of the club in undesirable ways during the act of swinging a club on the course or in practice. While it is known in the prior art to put lead weights down the center of the shaft during re-shafting or to use lighter grips during re-gripping, such changes create the issue of removal of such weights thereafter from inside the shaft if an undesirable swing weight is reached or the club simply does not feel right to the golfer when it is swung. Needless to say, adjustment of swing weight can be considerably complicated when a shaft is shortened or a lighter overall shaft is installed during grip replacement. Since grips are the most frequently changed item on a club, it would be helpful if there were a method and system of providing a change in swing weight in a predictable way by choice of grips which could rebalance the shaft in a predetermined and desirable way. The present invention solves these problems in the limitations of assembly and re-assembly and the use of lead tape or lead pellets under grips or down the shaft to achieve the desired swing weight.

SUMMARY OF THE INVENTION

The present invention is embodied in a system and method by which grips with individual predetermined weights, both in total weight and longitudinally, may be used to balance the club swing weight. Thus, the grips of the present invention may be used to alter swing weight in a predictable and systematic way to achieve the desired swing weight without unnecessary trial and error, and a desired weight usually can be achieved before the club is to be reassembled with new grips. The invention also has the benefit of avoiding common issues encountered in the past related to movable weights in the head and weights being positioned down the shaft that detrimentally move the sweet spot from the center of the club face towards the heel to achieve a specific swing weight after the club is assembled. The present invention can dramatically shorten the amount of time that it takes to achieve a desired swing weight if a club is shortened or lengthened or if a new and different shaft is used with the previously used golf club head, a procedure much more frequently used in modern design to take advantage of launch monitor or golf performance monitoring technology.

In a presently preferred embodiment, a sequence of easily removed "test" grips with known total and longitudinal weights may be used so that a desirable grip weight and swing weight can be achieved without requiring tedious assembly and disassembly of golf clubs. In another aspect of the present invention, both such test grips and the final grips to be installed may be fitted with end caps which may be removed and replaced to easily provide the desired grip weight and swing weight to a high accuracy of what is desired.

Other features and advantages of the present invention will become more apparent from the following detailed description of the preferred embodiments in conjunction with the accompanying drawings, which illustrate, by way of example, the operation of the invention.

BRIEF DESCRIPTION OF THE DRAWINGS

FIG. 1 is a cross section of a golf grip of the prior art.

FIG. 2 is a cross section of a golf grip of a comparatively heavy grip for re-gripping according to the invention.

FIG. 3*a* is a cross section of a relatively light grip for use with the invention.

FIG. 3*b* is an axial cross section of the grip of FIG. 3*a*.

FIG. 4 is a cross section of a test grip to be used for the purpose of variable grip weight estimation and preassembly.

FIG. 4*a* is an end view of a variable weight which can be changed to alter grip weight.

FIG. 5 is a cross section of a test grip showing the addition of an end cap with longitudinal weight to be used to "fine-tune" longitudinal weight of the grip.

FIG. 5*a* is a side view longitudinal weight which can be installed in a grip to tune swing weight in final assembly.

FIG. 5*b* is a grip illustrating the installation of the weight of FIG. 5*a* in a grip after assembly on a club shaft.

DETAILED DESCRIPTION OF THE PREFERRED EMBODIMENTS

The present invention accordingly provides for a system and method to re-grip golf clubs utilizing a series of systematically weighted grips used to balance the swing weight of a golf club. A standard grip is usually about 50 grams (on average). The series of weighted grips may be provided in 5 gram increments from 25 to 60 grams in weight. The user may, however, choose to be more exact and implement grips with 2 or 3 gram increments if necessary. The present system allows the exact swing weight of a club to be determined based on the grip weight. The relationship is such that, as the grip is lightened, the heavier the swing weight will be. As weight is added to the grip end the swing weight will be decreased. This system allows the player to achieve a desired swing weight without undue and tedious trial and error. As an example, when a player shortens a club, for every one inch the club is shortened the club will lose about 5 swing weights, depending on shaft weight and club head design. Swing weight in golf is an indication of how "heavy" a club head feels in a golfer's hands. It is a golf specific scale that commonly is measured in terms of A, B, C, D, E and F weights and numerical numbers from 1-9 for each alphabetic denomination. The most common weights are in the C and D weight range.

In the past, players have had to use lead tape to try and maintain the same swing weight of a club before the club is shortened. It was messy and awkward as to where to put the tape on the head and it added to the overall weight of that club. As an example, if a player shortens a driver half of an inch about 2 swing weights are lost. If the club had a 50 gram grip and the club is D2 before the half inch was cut off, a 45 gram grip according to the invention can be used to regain 2 swing weights and balance the club back to D2. If we would like an even heavier swing weight, of say D4, one can use a 40 gram grip and achieve a desired D4 swing weight. Similarly, if the player wishes to lighten a swing weight from D2 to D0, a 55 gram grip can be used to lose 2 points and come out to D0 if so desired. Note the user optionally may choose 2 or 3 gram intervals to provide even more precise weighting.

Referring to FIG. 2, for a conventional rubber grip 10 the invention can use a series of circular air pockets 20 within the grip that will control the weight. The larger the air pockets the less rubber is needed and the lighter the grip will weigh. It may be graduated from small pockets on the 45 gram grip and get larger 30 as the grip gets lighter, as illustrated in FIGS. 2 and 3. The 25 gram grip will have the largest air pockets and the 50, 55 and 60 gram grips could be solid rubber. Another means of achieving this result would be to use lighter rubber compounds to make the grip.

For a multi-layer grip the invention can adjust the weight by controlling the under listings weight in 5 gram intervals since the outer layer will always remain constant. An under listing is a smaller version of a rubber grip that has an outer layer already attached to it.

A presently preferred embodiment fitting system provides one "Fitting Grip" 30 of each of the 8 different gram weighted grips (25, 30, 35, 40, 45, 50, 55 and 60 grams). As illustrated in FIG. 4, the grip will be cut 32 or manufactured with a cut or void allowing the grip to be put on the bare shaft 12 and can be checked for balance along one entire side lengthwise so that the player can attach one of the desired "Fitting Grips" 30 on to the end of the shaft to see what the swing weight will become. Note: The addition of one wrap of "two way" tape that is used to adhere the grip to the shaft will decrease the swing weight about 1 swing weight. This "Fitting Grip" will take much of the guess work out of golf club assembly, particularly when the total length and swing weight are to be substantially altered, and to make sure the swing weight comes out correctly without having to use time consuming trial assembly and disassembly calculations.

Referring to FIG. 4*a*, the invention may use different end cap numbers, colors or paint fills 40 on the top of the grips of these "same design and looks" grips to differentiate the grips in an easy to use system of end cap colors or perhaps different color paint fill on the butt end of the grip to differentiate the weights of the grips and make them easier to work with and keep separated at the retail level. In one aspect of the invention, for example, we may choose red end caps or paint fill to equal the 25 gram grips, blue end caps or paint fill to equal 30 gram grips and white end caps or paint fill to equal 35 gram grips etc., so customers and staff will know immediately the weights of each grip in this "end cap color or paint fill color coded system."

The user may also choose to make the entire grip in specific colors in a color coded system to represent the different weighted grips. For example, we may chose red grips to equal the 25 gram grips, blue to equal 30 gram grips and white to equal 35 gram grips etc., so customers and staff will know immediately the weights of each grip in this "entire grip color specific system." Such a system of color coding would be particularly useful for test grips of the method of this invention.

There can also be midsize and oversize versions available for the grips of the invention along with putter grips to achieve the head weight/swing weight the player desires.

In order to make the grips in those weights described above, the grips should be lighter than the traditional standard weighted grips that are generally around 50 grams. In order to achieve this, the invention can use lighter weight materials to be used in multi-layered grips or a series of voids within the grips for "traditional" rubber-type grips. How it is exactly done will be done in the well-known manufacturing process of the grips by the companies who manufacture them.

As illustrated in FIG. 5, both the fitting grip 30 and final installed grip 60 may make use of a further weighting element 50. As shown in FIG. 5*a*, weighting element 50 may be threaded into the grips by threads 52 on the cap weight 50 mating to similar threads in grip 34 as desired and with extended weight 54 to vary in a more vernier fashion the swing weight and distribution of weight in the grip.

From the above, it may be seen by those skilled in the art of club assembly and repair that the present invention represents important advantages over previous systems.

I claim:

1. A system for modifying swing weight of a golf club having a club head, a shaft and a grip area, comprising:

a plurality of interchangeable weighted tubular fitting grips having a length and a tubular outer wall configured to be removably mounted on the grip area of the golf club, said plurality of interchangeable weighted fitting grips having a sequence of systematically varying predetermined weights, respectively, each of said plurality of interchangeable weighted tubular fitting grips having a longitudinal cut extending through one side of said tubular outer wall along said length allowing each of said plurality of interchangeable weighted tubular fitting grips to be removably mounted on the grip area of the golf club, and wherein each grip of said plurality of interchangeable weighted fitting grips is formed with a plurality of circular air pockets of different depths radially inward from a central axis of the grip into said wall when compared to the same longitudinal location of each other grip of said plurality of said grips to control the weight of each of said plurality of interchangeable weighted fitting grips, respectively.

2. The system of claim 1, wherein each of said plurality of interchangeable weighted tubular fitting grips vary as to total weight and weight along said length, respectively.

3. The system of claim 1, wherein each of said plurality of interchangeable weighted fitting grips is formed of rubber.

4. The system of claim 1, wherein each of said plurality of interchangeable weighted fitting grips is formed of a plurality of layers of material including an outer layer and at least one under listings layer of material.

5. The system of claim 1, further comprising at least one wrap of weighted tape configured to adhere each of said plurality of interchangeable weighted tubular fitting grips, respectively, to the grip area of the golf club.

6. The system of claim 5, wherein each said at least one wrap of weighted tape is configured to decrease the swing weight of the golf club one swing weight increment.

7. The system of claim 1, wherein at least a portion of each of said plurality of interchangeable weighted tubular fitting grips have different colors to differentiate different weights of each of said plurality of interchangeable weighted tubular fitting grips, respectively.

8. The system of claim 1, wherein each of said plurality of interchangeable weighted tubular fitting grips have an end cap, and each of said end caps of said plurality of interchangeable weighted tubular fitting grips having different colors to differentiate different weights of each of said plurality of interchangeable weighted tubular fitting grips, respectively.

9. A method for modifying swing weight of a golf club having a club head, a shaft and a grip area, comprising the steps of:

providing a plurality of interchangeable weighted tubular fitting grips having a length and a tubular outer wall configured to be removably mounted on the grip area of the golf club, said plurality of interchangeable weighted fitting grips having a sequence of systematically varying predetermined weights, respectively, each of said plurality of interchangeable weighted tubular fitting grips having a longitudinal cut extending through one side of said tubular outer wall along said length allowing each of said plurality of interchangeable weighted tubular fitting grips to be removably mounted on the grip area of the golf club, and wherein each grip of said plurality of interchangeable weighted fitting grips is formed with a plurality of circular air pockets of different depths radially inward from a central axis of the grip into said wall when compared to the same longitudinal location of each other grip of said plurality of said grips to control the weight of each of said plurality of interchangeable weighted fitting grips, respectively;

selecting a desired one of said plurality of interchangeable weighted tubular fitting grips configured to produce a desired swing weight of the golf club; and removably mounting desired one of said plurality of interchangeable weighted tubular fitting grips to the grip area of the golf club to achieve a desired swing weight of the golf club based on the weight of said desired one of said plurality of interchangeable weighted tubular fitting grips.

10. The method of claim 9, further comprising the step of adhering said desired one of said plurality of interchangeable weighted tubular fitting grips to the grip area of the golf club with at least one wrap of a weighted tape to decrease the swing weight of the golf club one swing weight increment per each wrap of said weighted tape.

* * * * *